US012364897B2

(12) United States Patent
Zhang

(10) Patent No.: US 12,364,897 B2
(45) Date of Patent: Jul. 22, 2025

(54) HIGH-RELIABILITY ADJUSTABLE DUMBBELL

(71) Applicant: Xiwen Shen, Changzhou (CN)

(72) Inventor: Xun Zhang, Funing (CN)

(73) Assignee: Xiwen Shen, Changzhou (CN)

( * ) Notice: Subject to any disclaimer, the term of this patent is extended or adjusted under 35 U.S.C. 154(b) by 0 days.

(21) Appl. No.: 18/938,077

(22) Filed: Nov. 5, 2024

(65) Prior Publication Data

US 2025/0058164 A1 Feb. 20, 2025

(30) Foreign Application Priority Data

May 23, 2024 (CN) ..... 202421136561.X

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/075; A63B 21/0726; A63B 21/0728
See application file for complete search history.

(56) References Cited

U.S. PATENT DOCUMENTS 10,518,123 B2 * 12/2019 Moran ..... A63B 21/0726
12,246,207 B1 * 3/2025 Yu ..... A63B 21/075
2014/0206510 A1 7/2014 Svenberg et al.
2016/0166873 A1 * 6/2016 Liu ..... A63B 21/0726 482/107
2017/0001061 A1 * 1/2017 Marjama ..... A63B 71/0036
2017/0239510 A1 * 8/2017 Wang ..... A63B 21/0724
2017/0252599 A1 * 9/2017 Wang ..... A63B 21/0726
2018/0117386 A1 * 5/2018 Wang ..... A63B 71/0036
2018/0264308 A1 * 9/2018 Wang ..... A63B 21/075
2018/0353794 A1 * 12/2018 Wang ..... A63B 71/0036
2020/0398100 A1 * 12/2020 Wang ..... A63B 21/0726
2022/0047908 A1 * 2/2022 Weng ..... A63B 21/0728
2022/0088432 A1 * 3/2022 Wang ..... A63B 21/0724
2022/0176186 A1 * 6/2022 Chen ..... A63B 21/075
2022/0193481 A1 6/2022 Wu et al.
2022/0347512 A1 * 11/2022 Hong ..... A63B 21/0728
2023/0271050 A1 * 8/2023 Tong ..... A63B 21/0728 482/108
2024/0226639 A1 7/2024 Kuczminski et al.
2025/0090889 A1 * 3/2025 Hong ..... A63B 21/0728

* cited by examiner

*Primary Examiner* — Joshua T Kennedy

(57) ABSTRACT

A high-reliability adjustable dumbbell, including a base for placing dumbbell plates, the dumbbell plates, a handle, a self-locking module, and several chucks mounted on a rod body. Rotation of the handle drives the chucks to rotate, and the chucks are clamped with or staggered from the dumbbell plates. By the arrangement of the self-locking module, the present disclosure ensures the stability of the dumbbell during use and prevents the dumbbell plates from sliding off during movement, thus ensuring the safety of use by a user. Meanwhile, the dumbbell can be locked on the base to prevent accidental collision and falling of the dumbbell plates.

10 Claims, 11 Drawing Sheets

HIGH-RELIABILITY ADJUSTABLE DUMBBELL

TECHNICAL FIELD

The present disclosure relates to the technical field of fitness equipment, and in particular, to a high-reliability adjustable dumbbell.

BACKGROUND

With the improvement of the living standard and the increasing concern for health, fitness has become a part of the daily life. Dumbbells, as important fitness equipment, are widely used in homes and gyms. A traditional dumbbell is usually composed of metal plates with fixed weights. A user needs to spend a lot of time and use a lot of effort in replacing dumbbells with different weights. This is very inconvenient for high-intensity interval training or a training mode that require frequent weight changing. In addition, the traditional dumbbell further has the following problems during use: Firstly, it is inconvenient to adjust the weight because dumbbell plates need to be manually removed and mounted. Secondly, a storage space is relatively large because dumbbells with various weights require a large storage space. Thirdly, the safety of use is relatively low because the dumbbell plates are easily loosened during movement, causing a safety potential hazard.

In recent years, there have been some weight-adjustable dumbbell products on the market. These dumbbell products usually achieve the function of quickly adjusting the weight of the dumbbell through a central handle and a set of internal mechanism. Although these products have solved some of the problems of the traditional dumbbell, there are still some shortcomings in practical use, such as, unsmooth adjustment, a high failure rate caused by a complex structure, inability of self-lock when the product is placed on a base, and falling of a dumbbell plate when the product is picked up. Therefore, a high-reliability adjustable dumbbell is provided, which solves the above problems.

SUMMARY

The present disclosure aims to provide a high-reliability adjustable dumbbell, which has a simple structure and is convenient to operate. When not in use, the adjustable dumbbell can be locked on a base. During use, a handle can be locked and prevented from rotating, thereby preventing dumbbell plates from falling off accidentally.

The present disclosure provides a high-reliability adjustable dumbbell, including a base for placing dumbbell plates, dumbbell plates, a handle, and several chucks mounted on a rod body. Rotation of the handle drives the chucks to rotate, and the chucks are clamped with or staggered from the dumbbell plates, to achieve automatic adjustment of the weight of the dumbbell. The high-reliability adjustable dumbbell further includes self-locking modules mounted on the rod body. Each self-locking module includes a stopper plate, a first locking disk, a second locking disk, a shell, a locking block, a cover plate, and a fixed frame. The first locking disk is fixed on an inner side of the stopper plate, and the second locking disk is clamped with the stopper plate. The first locking disk and the second locking disk are both provided with convex sheets spaced apart from each other. The fixed frame is fixed on the cover plate. The cover plate seals the fixed frame, the first locking disk, and the second locking disk inside the shell. The locking block is mounted in the fixed frame through a reset spring. The stopper plate is rotatably mounted on the shell and is clamped with the handle. The base is further provided with a convex block and a locking plate. When the handle rotates, the handle drives the stopper plate, the first locking disk, the second locking disk, and the convex sheets to rotate. When the dumbbell is placed on the base, the convex block on the base jacks up the locking block, so that the convex sheets of the second locking disk can automatically pass through a locking slot of the locking block, and the handle can freely rotate to achieve weight adjustment. When the dumbbell is separated from the base, the locking block presses down the reset spring, so that the convex sheets of the second locking disk are locked on the locking block, and the second locking disk cannot rotate. Thus, the handle cannot rotate, and the dumbbell plates cannot be separated from the chucks. When the convex sheets of the first locking disk are locked on the locking plate of the base, the dumbbell and the base are locked, and the dumbbell is fixed on the base.

Preferably, annular through holes are distributed on inner sides of the convex sheets of the second locking disk; the fixed frame is provided with a pressing ball for pressing the through holes of the second locking disk; and an elastic member for resisting against the second locking disk is further mounted on the stopper plate to reduce friction during the rotation of the second locking disk.

Preferably, the base is provided with several grooves configured to place the dumbbell plates to restrict the dumbbell plates from being loosened.

Preferably, the dumbbell plates are "U"-shaped, which are provided with sunken surfaces in centers; the sunken surfaces abut against the chucks; the chucks clamp clamping blocks protruding out of the sunken surfaces of the dumbbell plates through clamping rings.

Further, circumferential areas occupied by the clamping rings on the chucks decrease in sequence from a position close to the handle to a position away from the handle, to achieve weight adjustment on the dumbbell plates.

Preferably, decorative covers are mounted at two ends of the rod body, and the decorative covers are fixedly connected to the self-locking modules through the connecting sheets.

Compared with the prior art, the present disclosure has the following outstanding advantages:

- high safety: The unique design of the self-locking modules ensures the stability of the dumbbell during use and prevents the dumbbell plates from sliding off during movement, thus ensuring the safety of use by a user. Meanwhile, the dumbbell can be locked on the base to prevent accidental collision and falling of the dumbbell plates.

The high-reliability adjustable dumbbell has a compact structure and high safety, and parts have a simple and reliable structure. In summary, the adjustable dumbbell of the present disclosure not only overcomes many shortcomings in the prior art, but also has many advantages. It is ideal household and commercial fitness equipment.

BRIEF DESCRIPTION OF THE DRAWINGS

To describe the technical solutions in the embodiments of the present disclosure more clearly, the following briefly introduces the accompanying drawings for describing the embodiments. Obviously, the accompanying drawings in the following description show merely some embodiments of the present disclosure, and a person of ordinary skill in the art may still derive other drawings from the accompanying drawings without creative efforts.

REFERENCE NUMERALS IN THE DRAWINGS

Figure 1:
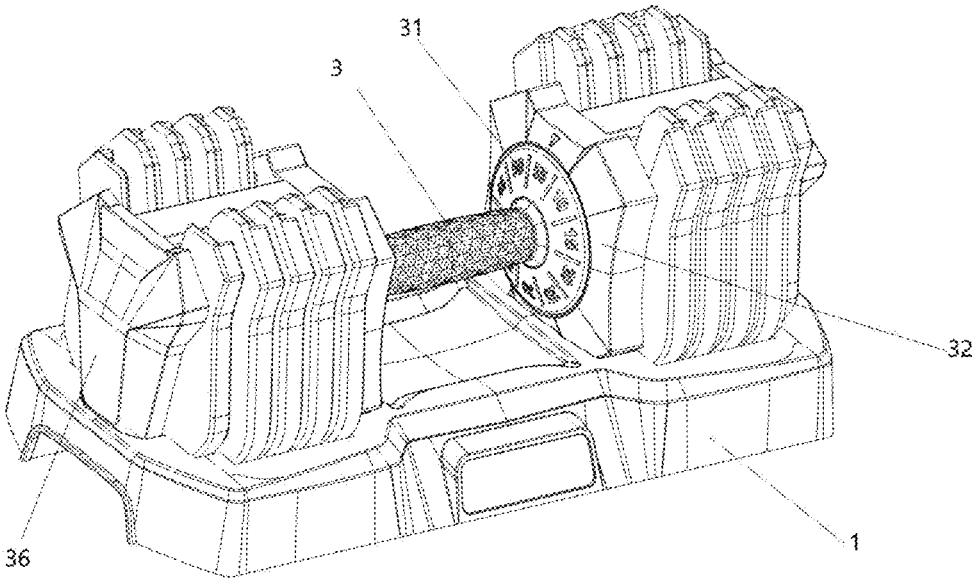
FIG. 1 is a schematic overall diagram according to a first embodiment of the present disclosure.
Figure 2:
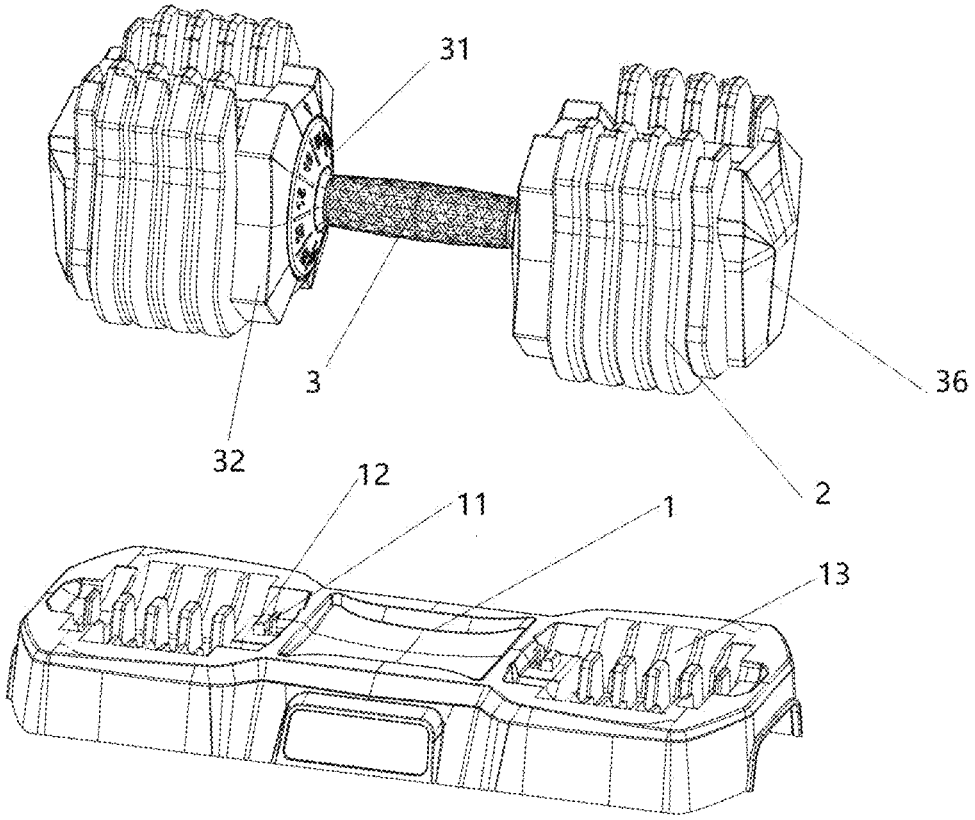
FIG. 2 and FIG. 3 are schematic diagrams of use according to a first embodiment of the present disclosure.
Figure 3:
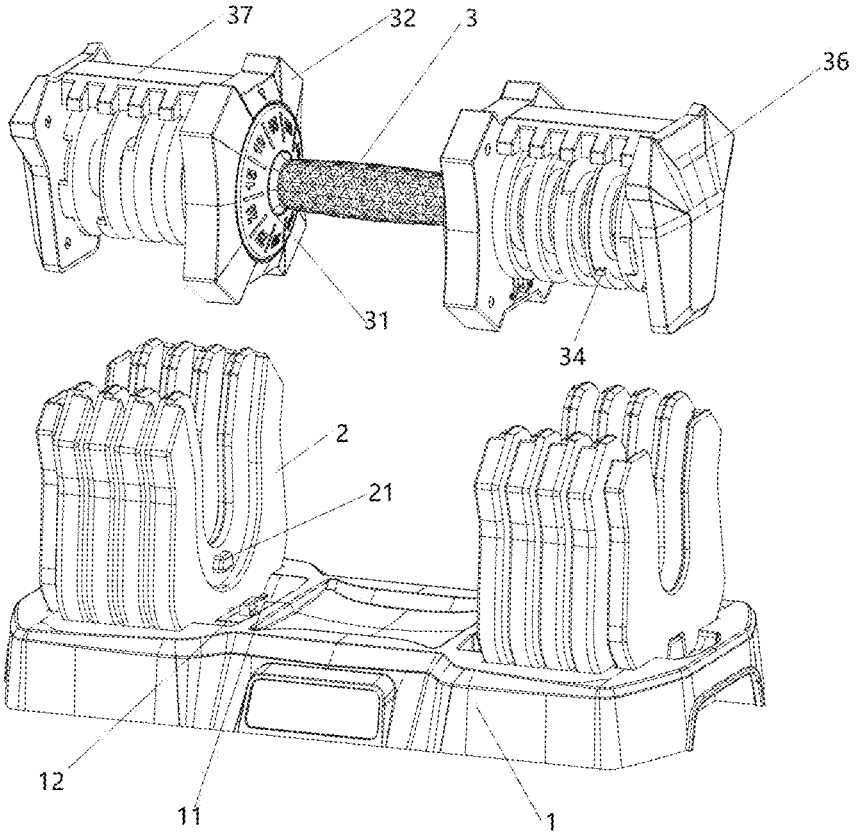

1: base; 11: locking plate; 12: convex block; 13: groove; 2: dumbbell; 21: clamping block; 22: sunken surface; 3: handle; 31: stopper plate; 32: self-locking; 321: shell; 322: first locking disk; 3221: convex sheet; 323: elastic member; 324: second locking disk; 325: reset spring; 326: locking block; 327: fixed frame; 328: pressing ball; 329: cover plate; 33: rod body; 34: chuck; 341: clamping ring; 342: transmission end; 36: decorative cover; 37: connecting sheet.

Through the above accompanying drawings, clear embodiments of the present disclosure have been shown, which will be described in more detail below. These accompanying drawings and textual descriptions are not intended to limit the scope of the concept of the present disclosure in any way, but rather to illustrate the concept of the present disclosure for those skilled in the art by referring to specific embodiments.

DETAILED DESCRIPTION OF THE EMBODIMENTS

The technical solutions in the embodiments of the present disclosure are clearly and completely described below with reference to the accompanying drawings in the embodiments of the present disclosure. Apparently, the described embodiments are some embodiments of the present disclosure, rather than all the embodiments. All other embodiments obtained by a person of ordinary skill in the art based on the embodiments of the present disclosure without making creative efforts shall fall within the protection scope of the present disclosure.

It should be noted that when an element is referred to as being "fixed to" another element, the element can be directly on another component or there can be a centered element. When an element is considered to be "connected" to another element, the element can be directly connected to another element or there may be a centered element. On the contrary, when an element is considered to be "directly on" another element, there is no intermediate element. The terms "vertical", "horizontal", "left", "right", and similar expressions used herein are for illustrative purposes only and do not necessarily represent the only implementation. The terms "upper end", "lower end", "left side", "right side", "front end", "rear end", and similar expressions used herein are positional relationships in the drawings.

To make the technical solutions and advantages of the present disclosure clearer, the following further describes implementations of the present disclosure in detail with reference to the accompanying drawings.

As shown in FIG. 1 to FIG. 11, the present disclosure provides a high-reliability adjustable dumbbell, including a base 1 for placing dumbbell plates 2, the dumbbell plates 2, a handle 3, and several chucks 34 mounted on a rod body 33. Rotation of the handle 3 drives the chucks 34 to rotate, and the chucks 34 are clamped with or staggered from the dumbbell plates 2, to achieve automatic adjustment of the weight of the dumbbell. The high-reliability adjustable dumbbell further includes self-locking modules 32 mounted on the rod body 33. Each self-locking module 32 includes a stopper plate 31, a first locking disk 322, a second locking disk 324, a shell 321, a locking block 326, a cover plate 329, and a fixed frame 327. The first locking disk 322 is fixed on an inner side of the stopper plate 31, and the second locking disk 324 is clamped with the stopper plate 31. The first locking disk 322 and the second locking disk 324 are both provided with convex sheets 3221 spaced apart from each other. The fixed frame 327 is fixed on the cover plate 329. The cover plate 329 seals the fixed frame 327, the first locking disk 322, and the second locking disk 324 inside the shell 321. The locking block 326 is mounted in the fixed frame 327 through a reset spring 325. The stopper plate 31 is rotatably mounted on the shell 321 and is clamped with the handle 3. The base 1 is further provided with a convex block 12 and a locking plate 11. When the handle 3 rotates, the handle drives the stopper plate 31, the first locking disk 322, the second locking disk 324, and the convex sheets 3221 to rotate. When the dumbbell is placed on the base 1, the convex block 12 on the base 1 jacks up the locking block 326, so that the convex sheets 3221 of the second locking disk 324 can automatically pass through a locking slot of the locking block 326, and the handle 3 can freely rotate to achieve weight adjustment. When the dumbbell is separated from the base 1, the locking block 326 presses down the reset spring 325, so that the convex sheets 3221 of the second locking disk 324 are locked on the locking block 326, and the second locking disk 324 cannot rotate. Thus, the handle 3 cannot rotate, and the dumbbell plates 2 cannot be separated from the chucks 34. When the convex sheets 3221 of the first locking sheets 322 are locked on the locking plate 11 of the base 1, the dumbbell and the base 1 are locked, and the dumbbell is fixed on the base 1. The base 1 is provided with several grooves 13 configured to place the dumbbell plates 2 to restrict the dumbbell plates 2 from being loosened. The dumbbell plates 2 are "U"-shaped, which are provided with sunken surfaces 22 in centers; the sunken surfaces 22 abut against the chucks 34; the chucks 34 clamp clamping blocks 21 protruding out of the sunken surfaces 22 of the dumbbell plates 2 through clamping rings 341.

Figure 4:
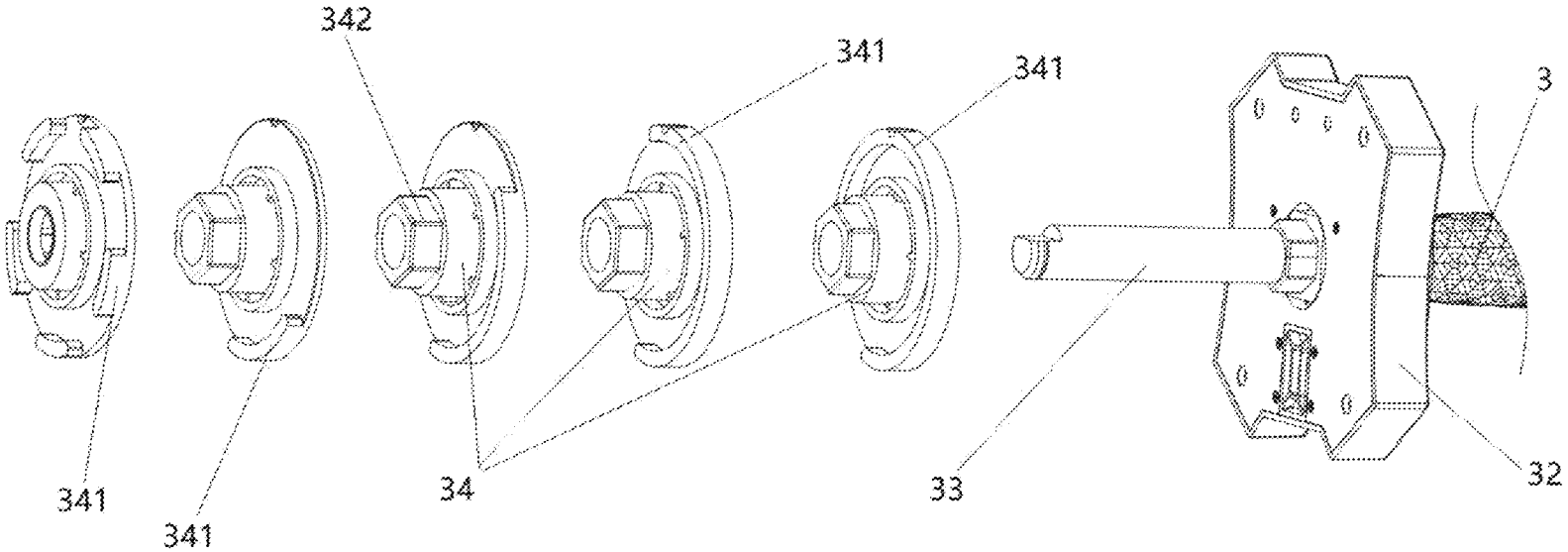
FIG. 4 is an exploded view of chucks and a rod body according to a first embodiment of the present disclosure.
Figure 5:
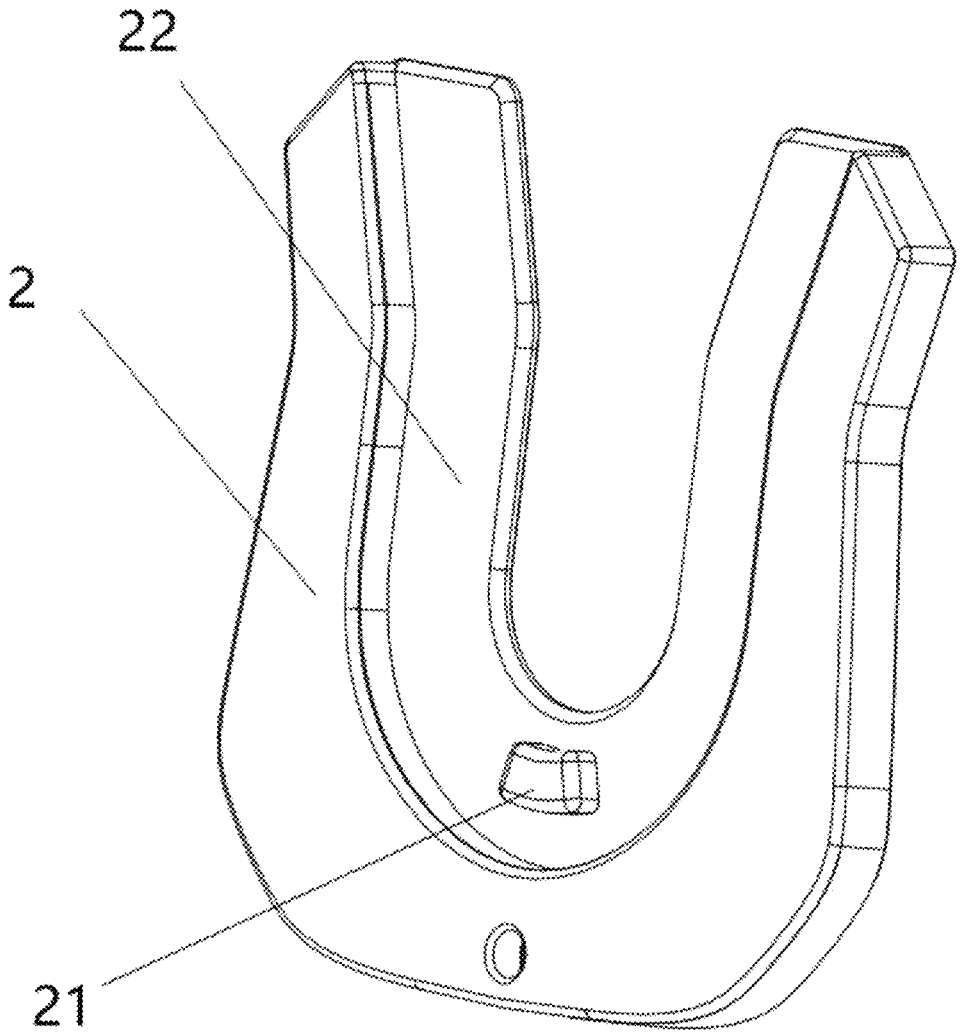
FIG. 5 is a schematic structural diagram of a dumbbell according to a first embodiment of the present disclosure.
Figure 6:
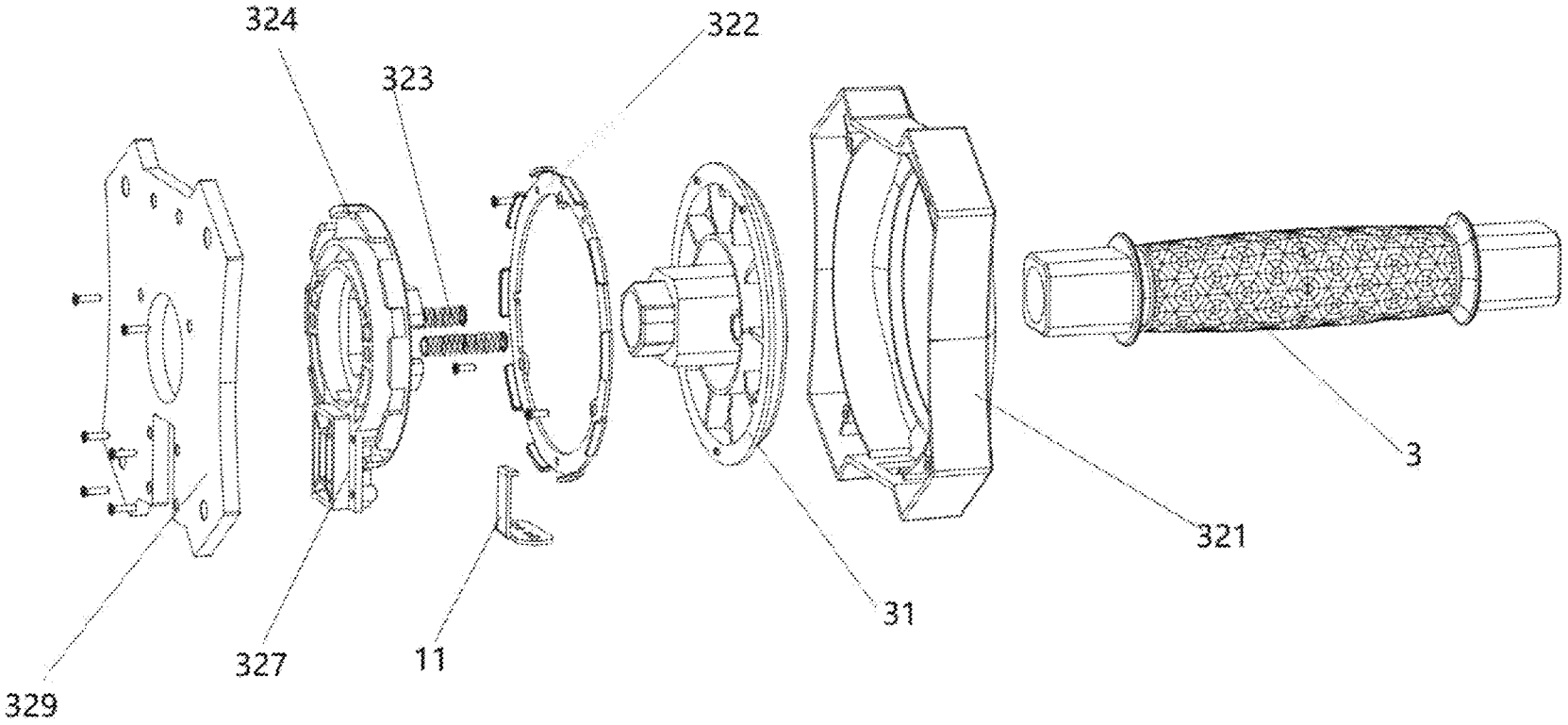
FIG. 6 is an exploded view of a self-locking module according to a first embodiment of the present disclosure.

As shown in FIG. 4, circumferential areas occupied by the clamping rings 341 on the chucks 34 decrease in sequence a position close to the handle 3 to a position away from the handle 3, to achieve weight adjustment on the dumbbell plates 2.

Figure 8:
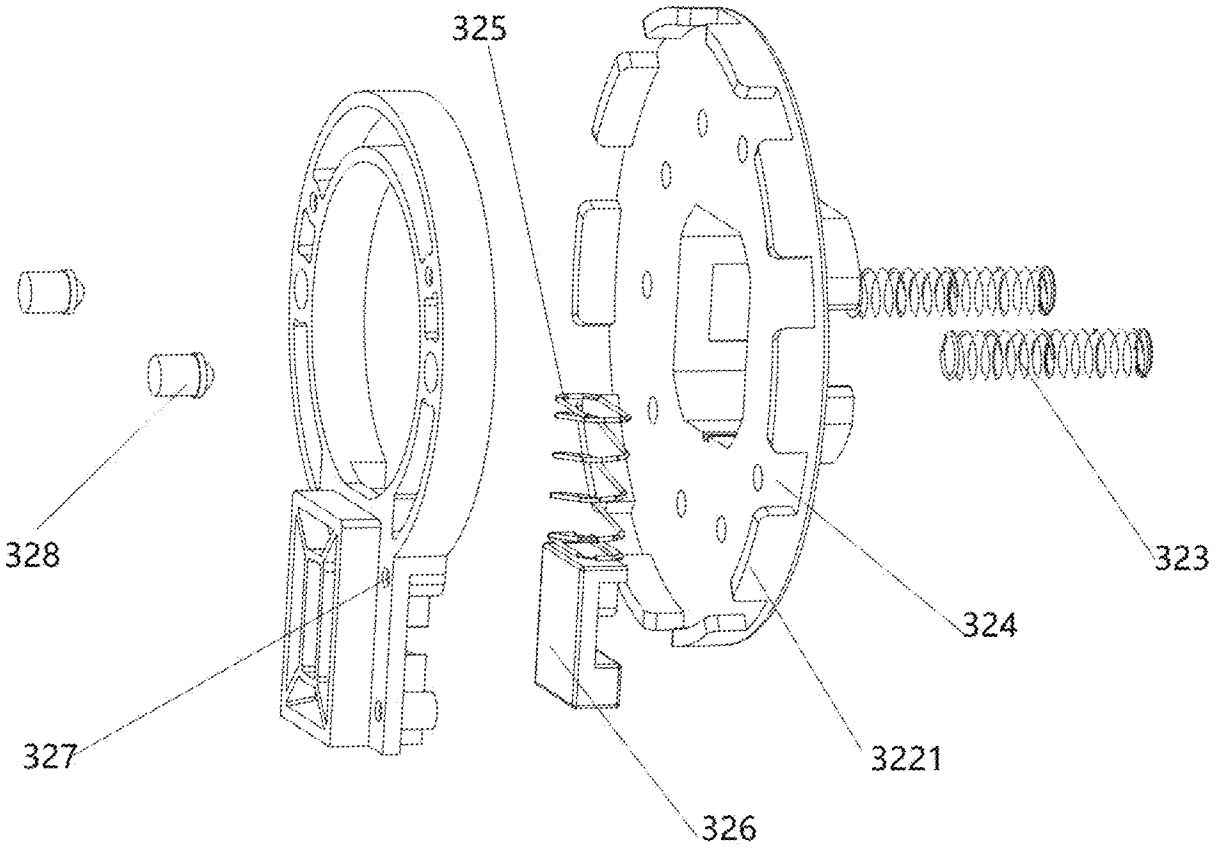
FIG. 8 is a schematic diagram of a second locking disk according to a first embodiment of the present disclosure.

As shown in FIG. 8, annular through holes are distributed on inner sides of the convex sheets 3221 of the second locking disk 324; the fixed frame 327 is provided with a pressing ball 328 for pressing the through holes of the second locking disk 324; and an elastic member 323 for resisting against the second locking disk 324 is further mounted on the stopper plate 31 to reduce friction during the rotation of the second locking disk 324. Decorative covers 36 are mounted at two ends of the rod body 33, and the decorative covers 36 are fixedly connected to the self-locking modules 32 through connecting sheets 37.

To have a more thorough and comprehensive understanding of the content disclosed by the present disclosure, the principle will be further explained in conjunction with its usage.

Figure 9:
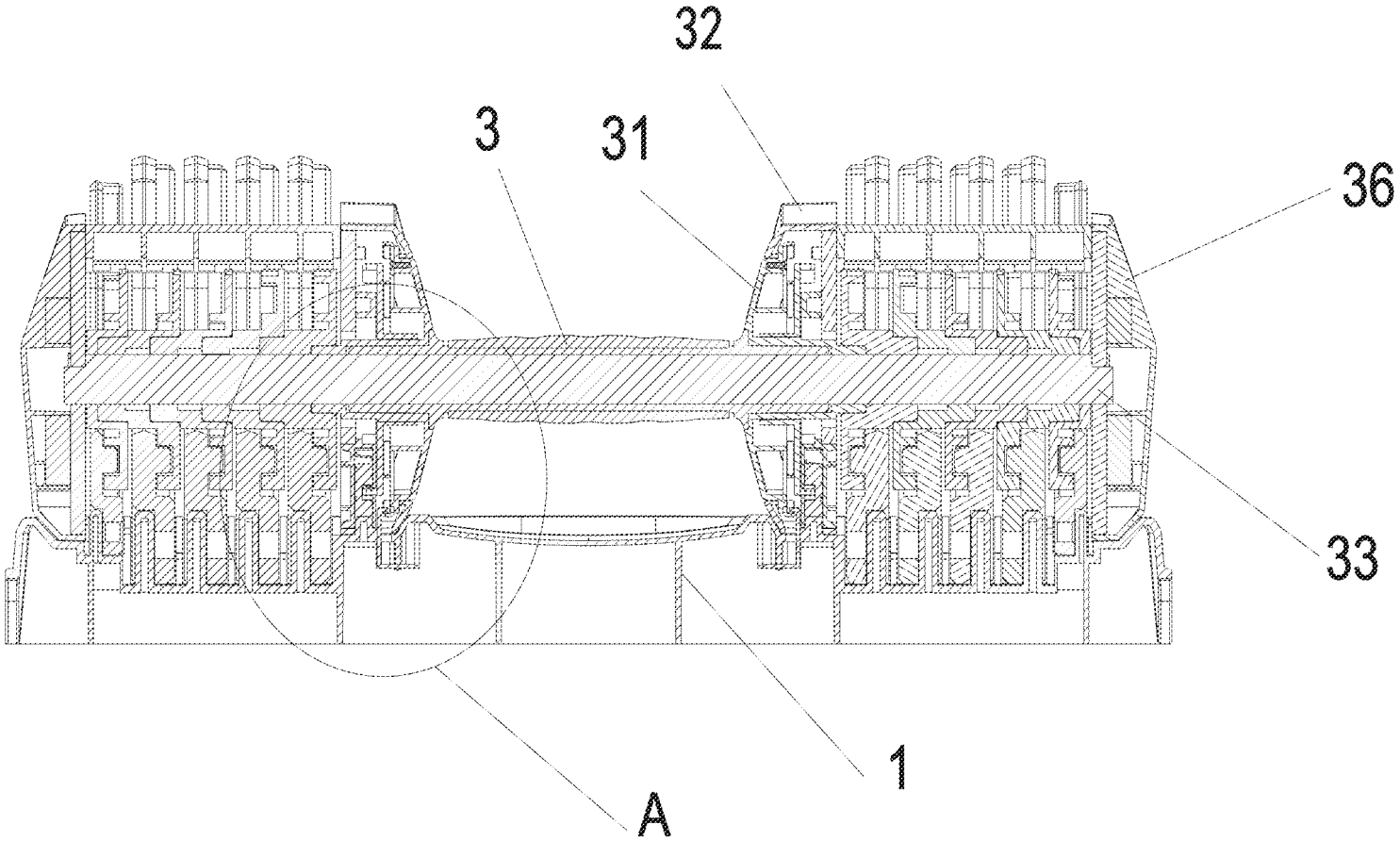
FIG. 9 is an overall cross-sectional view according to a first embodiment of the present disclosure.
Figure 10:
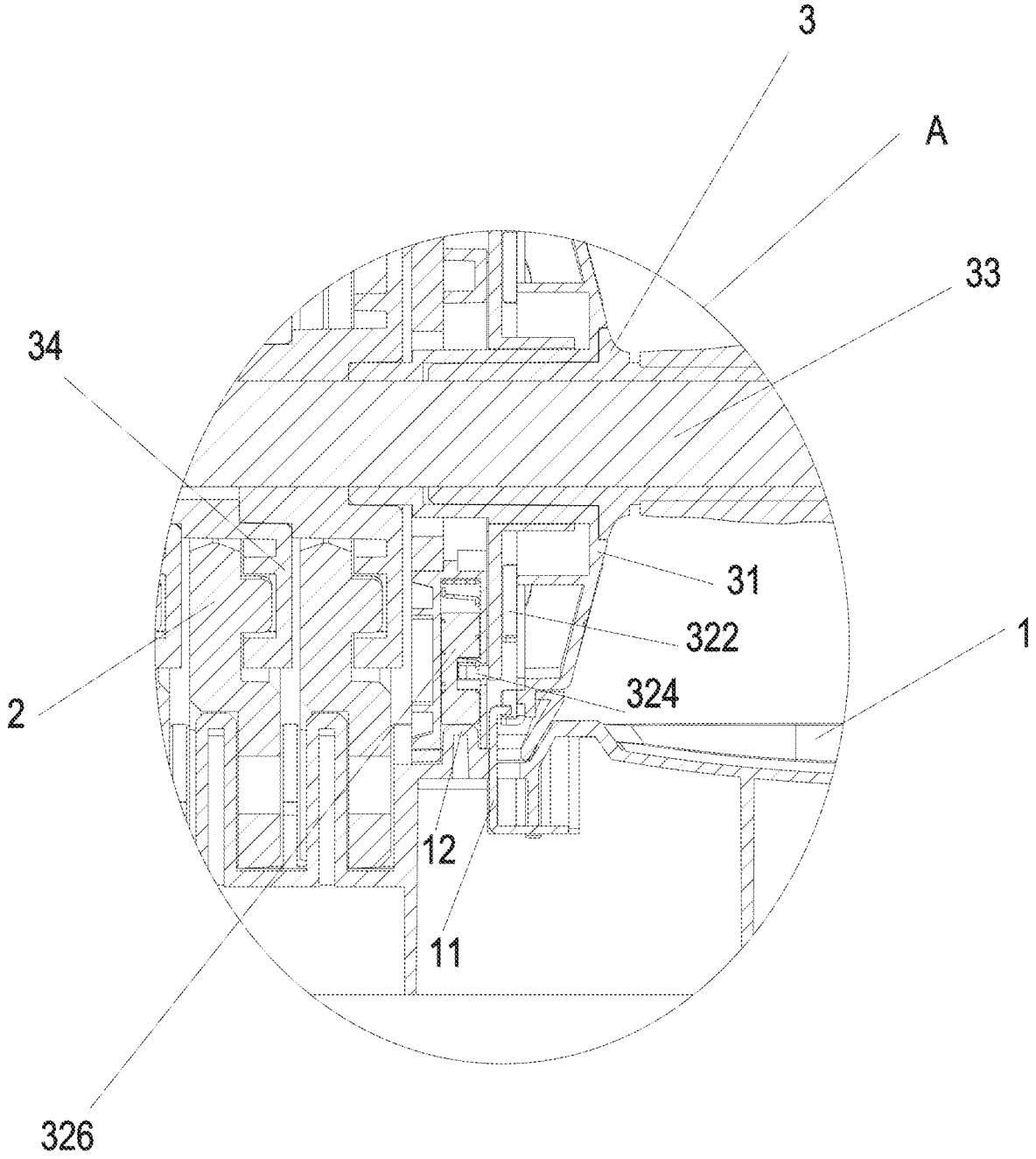
FIG. 10 is an enlarged view of part A according to a first embodiment of the present disclosure.
Figure 11:
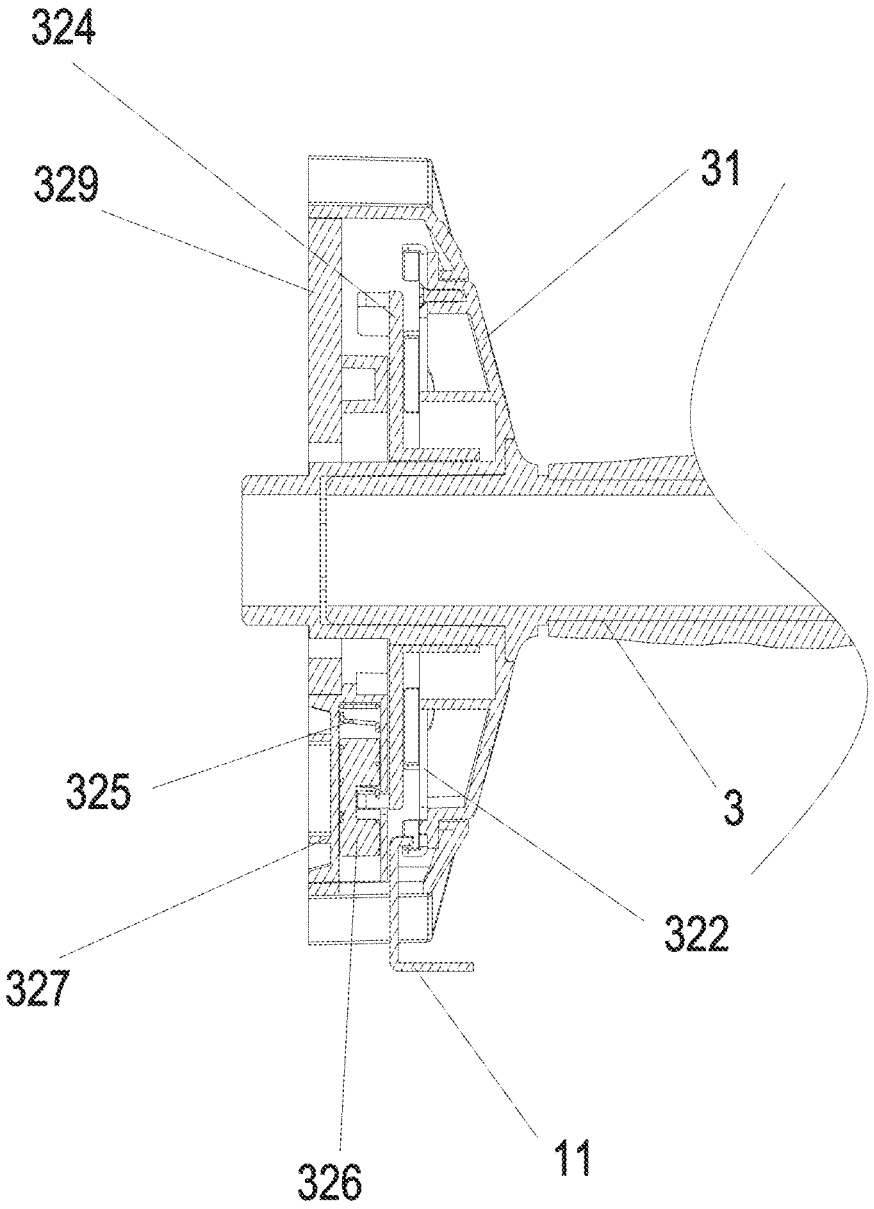
FIG. 11 is a cross-sectional view of a self-locking module according to a first embodiment of the present disclosure.

During use, the dumbbell is placed on the base 1. As shown in FIG. 9 to FIG. 11, the locking block 326 of the fixed frame 327 is jacked up by the convex block 12 of the base 1. The convex sheets 3221 of the second locking plate 324 can freely pass through a locking slot of the locking block 326. At this time, the handle 3 is rotated. The handle 3 will drive the stopper plate 31 to rotate. The first locking disk 322 fixed on the stopper plate 31 will also rotate. The stopper plate 31 further drives the second locking disk 324 and transmission ends 342 of the several chucks 34 to rotate with each other. As shown in FIG. 4, when the clamping rings 341 of the chucks 34 rotate to the clamping blocks 21 of the dumbbell plates 2, they will clamp the corresponding dumbbell plates 2, thereby changing the weight of the dumbbell.

If a pointer of the shell 321 does not face a pointer on the stopper plate 31 and is located between two numbers, the convex sheets 3221 of the first locking disk 322 may clamp the locking plate 11 of the base 1, so that the dumbbell cannot be separated from the base 1.

Figure 7:
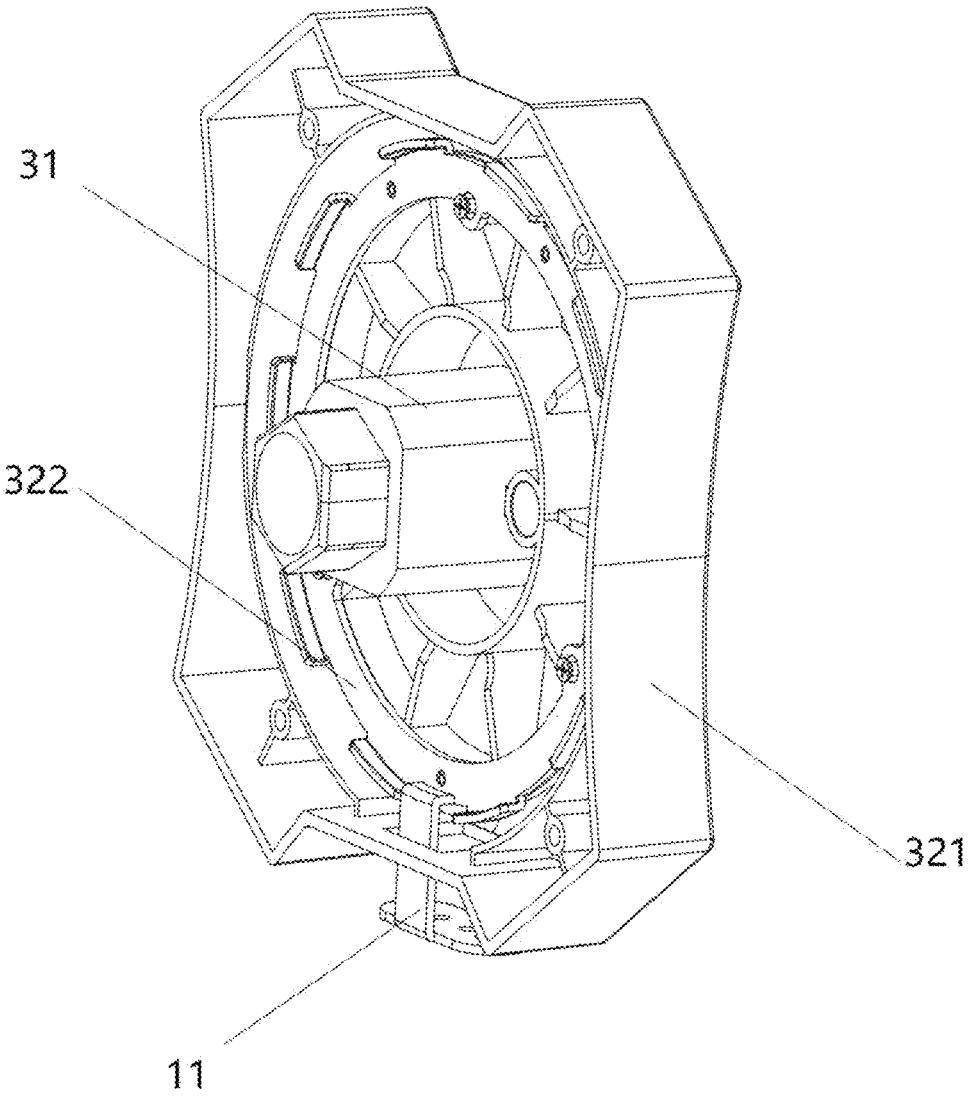
FIG. 7 is a schematic diagram of a first locking disk according to a first embodiment of the present disclosure.

In exercise, the handle 3 is rotated to assign scale on the stopper plate 31 to corresponding weights. At this time, the first locking disk 322 is staggered from the locking plate 11 of the base 1, and the dumbbell can be separated from the base 1, as shown in FIG. 7. When the dumbbell is separated from the base 1, as shown in FIG. 8 and FIG. 11, the locking block 326 is pressed down by the reset spring 325, and the convex sheets 3221 of the second locking disk 324 is locked by the locking block 326. The second locking disk 324 cannot rotate, which causes the handle 3 to be unable to rotate, and the dumbbell plates 2 cannot be separated from the chucks 34, thereby achieving self-locking and ensuring the safety.

Those skilled in the art will easily come up with other implementations of the present disclosure after considering this specification and implementing the present disclosure. The present disclosure aims to cover any variations, uses, or adaptive changes of the present disclosure, and these variations, uses, or adaptive changes follow the general principles of the present disclosure and include common knowledge or customary technical means in the technical field that are not disclose herein. The specification and the embodiments are considered as merely exemplary, and the scope and spirit of the present disclosure are pointed out in the following claims.

It should be understood that the present disclosure is not limited to the precise structures that have been described above and shown in the drawings, and various modifications and changes can be made without departing from the scope of the present disclosure. The scope of the present disclosure is subject only to the appended claims.

What is claimed is:

1. A high-reliability adjustable dumbbell, comprising a base (1) for a placing dumbbell plates, dumbbell plates (2), a handle (3), and a plurality of chucks (34) mounted on a rod body (33), wherein the handle (3) rotates to drive the chucks (34) to rotate; the plurality of (34) are clamped with or staggered from the dumbbell plates (2); the high-reliability adjustable dumbbell further comprises self-locking modules (32) mounted on the rod body (33); each self-locking module (32) comprises a stopper plate (31), a first locking disk (322), a second locking disk (324), a shell (321), a locking block (326), a cover plate (329), and a fixed frame (327); the first locking disk (322) is fixed on an inner side of the stopper plate (31); the second locking disk (324) is clamped with the stopper plate (31); the first locking disk (322) and the second locking disk (324) are both provided with convex sheets (3221) spaced apart from each other; the fixed frame (327) is fixed on the cover plate (329); the cover plate (329) seals the fixed frame (327), the first locking disk (322), and the second locking disk (324) inside the shell (321); the locking block (326) is mounted in the fixed frame (327) through a reset spring (325); the stopper plate (31) is rotatably mounted on the shell (321) and is clamped with the handle (3); the base (1) is further provided with a convex block (12) and a locking plate (11); when the handle (3) rotates, the handle drives the stopper plate (31), the first locking disk (322), the second locking disk (324), and the convex sheets (3221) to rotate; the convex sheets (3221) of the first locking disk (322) are unlocked or locked by the locking plate (11); and the convex sheets (3221) of the second locking disk (324) are unlocked or locked by the locking block (326).

2. The high-reliability adjustable dumbbell according to claim 1, wherein annular through holes are distributed on inner sides of the convex sheets (3221) of the second locking disk (324); the fixed frame (327) is provided with a pressing ball (328) for pressing the through holes of the second locking disk (324); and an elastic member (323) for resisting against the second locking disk (324) is further mounted on the stopper plate (31) to reduce friction during the rotation of the second locking disk (324).

3. The high-reliability adjustable dumbbell according to claim 1, further comprising connecting sheets (37), wherein the self-locking modules (32) and the connecting sheets (37) fix the plurality of chucks (34); the handle (3) rotatably sleeves the middle of the rod body (33); the handle (3) drives stopper sheets (343) on the plurality of chucks (34) to rotate by driving the stopper plates (31), so that pushing blocks (3431) of the stopper sheets (343) push clamping columns (344) out and lock the clamping columns into clamping holes (23) of the dumbbell plates (2); the plurality of chucks (34) are symmetrically mounted on the rod body (33), with at least two chucks of the plurality of chucks (34) on each side; the stopper sheets (343) of the plurality of chucks (34) on the sides are clamped with each other; each chuck (34) further comprises a carrying disk (345) and a fixing member (346) inside; at least two turns of reinforcing rings (3451) are arranged in the carrying disk (345); several reinforcing ribs (3452) are further connected between the reinforcing rings (3451); two clamping columns (344) are symmetrically mounted between the reinforcing rings (3451) and reinforcing ribs (3452) of the carrying disk (345); and the clamping columns (344) are wrapped around and fixed on the carrying disk (345) by the fixing member (346).

4. The high-reliability adjustable dumbbell according to claim 3, wherein outer springs (3441) are arranged on outer sides of the clamping columns (344) to rebound the clamping columns (344) to recesses of the stopper sheets (343); inner springs (3442) and balls (3443) are further arranged on inner sides of the clamping columns (344); and the inner springs (3442) push the balls (3443) towards the side with the stopper sheets (343), so that the balls (3443) are in contact with the pushing blocks (3431) of the stopper sheets (343).

5. The high-reliability adjustable dumbbell according to claim 1, wherein circumferential areas occupied by the pushing blocks (3431) of the stopper sheets (343) located on the same side of the handle (3) increase in sequence from a position close to the handle (3) to a position away from the handle (3), and the pushing blocks (3431) are symmetrically arranged on two sides of sleeves (3432); and the stopper sheets (343) on the same side are inserted into the sleeves (3432) through transmission shafts (3433) to achieve transmission.

6. The high-reliability adjustable dumbbell according to claim 1, wherein the base (1) is provided with a plurality of grooves (13) configured to place the dumbbell plates (2).

7. The high-reliability adjustable dumbbell according to claim 1, wherein the dumbbell plates (2) are "U"-shaped, which are provided with sunken surfaces (22) in centers; the sunken surfaces (22) abut against the plurality of chucks (34); the plurality of chucks (34) clamp clamping blocks (21) of the sunken surfaces (22) protruding out of the dumbbell plates (2) through clamping rings (341).

8. The high-reliability adjustable dumbbell according to claim 7, wherein circumferential areas occupied by the clamping rings (341) on the plurality of chucks (34) decrease in sequence from a position close to the handle (3) to a position away from the handle (3).

9. The high-reliability adjustable dumbbell according to claim 1, wherein decorative covers (36) are mounted at two ends of the rod body (33), and the decorative covers (36) are fixedly connected to the self-locking modules (32) through the connecting sheets (37).

10. The high-reliability adjustable dumbbell according to claim 1, wherein scales are provided on the stopper plates (31); and two ends of the stopper plates (31) are respectively clamped with the handle (3) and the stopper sheets (343), to transmit an angle of rotation of the handle (3) to the stopper sheets (343).

* * * * *